US005220965A

United States Patent [19]

Haug

[11] Patent Number: 5,220,965

[45] Date of Patent: Jun. 22, 1993

[54] VEHICLE FOR BEACH CLEANING

[75] Inventor: Walter Haug, Blaustein, Fed. Rep. of Germany

[73] Assignee: Karl Kaessbohrer Fahrzeugwerke GmbH, Fed. Rep. of Germany

[21] Appl. No.: 793,029

[22] Filed: Nov. 15, 1991

[30] Foreign Application Priority Data

Nov. 16, 1990 [DE] Fed. Rep. of Germany ... 9015718[U]

[51] Int. Cl.[5] ..... A01D 17/08

[52] U.S. Cl. ..... 171/116; 15/84; 171/134

[58] Field of Search ..... 171/116, 119, 111, 124, 171/126, 130, 120, 139, 141, 63, 65, 110; 15/82-84, 54, 55, 78; 460/904; 56/364

[56] References Cited

U.S. PATENT DOCUMENTS

| | | | |
|---|---|---|---|
| 2,915,995 | 12/1959 | Shelby | 171/116 |
| 4,328,603 | 5/1982 | Dickson et al. | 15/84 |
| 4,343,060 | 8/1982 | Hildebrand et al. | 15/84 |
| 4,484,019 | 11/1984 | Murphy | 171/63 |
| 4,608,725 | 9/1986 | Jackson | 15/84 |
| 4,895,476 | 1/1990 | Vangaever | 15/83 |
| 5,054,152 | 10/1991 | Hulicsko | 15/84 |

FOREIGN PATENT DOCUMENTS

| | | | |
|---|---|---|---|
| 1068051 | 10/1959 | Fed. Rep. of Germany | 171/141 |
| 1216132 | 11/1959 | France | 171/141 |
| 1589710 | 5/1981 | United Kingdom | 171/63 |
| 2210651 | 6/1989 | United Kingdom | 15/84 |
| 8501635 | 4/1985 | World Int. Prop. O. | 171/63 |

*Primary Examiner*—David H. Corbin
*Assistant Examiner*—Spencer Warnick
*Attorney, Agent, or Firm*—Samuels, Gauthier & Stevens

[57] ABSTRACT

A vehicle for beach cleaning has a vehicle frame with at least one wheel axis disposed on it. Garbage is picked up from the beach by a vertically adjustable garbage pickup and delivered to a conveyor adjoining the garbage pickup and conveying the garbage taken to a collecting receptacle disposed at the rear end of the vehicle frame. A supply rotor is allocated to the pickup area of the garbage pickup.

In order to improve the supply, the pickup and the transport of refuse and the separation of refuse and sand and the disposal of the pollutants, a swivel frame supporting the garbage pickup and the supply rotor is lowerably mounted on the vehicle frame for vertical adjustment, the supply rotor being mounted on the swivel frame pivotably across a swivel range comprising different operating conditions by means of links and being in particular counter-clockwise rotatable about an axis of rotation mounted on the links.

45 Claims, 8 Drawing Sheets

VEHICLE FOR BEACH CLEANING

BACKGROUND OF THE INVENTION

The invention relates to a vehicle for beach cleaning comprising a vehicle frame, at least one wheel axis disposed on it, a vertically adjustable garbage pickup, a conveyor adjoining the garbage pickup and conveying the garbage taken over from the garbage pickup to a collecting receptacle, disposed at the rear end of the vehicle frame and a supply rotor allocated to the pickup area of the garbage pickup.

Such a beach cleaning vehicle is known from U.S. Pat. No. 4,482,019. Refuse is picked up from the ground, e.g. a sandy beach, by a supply rotor designed with tines and conveyed to a conveyor belt. The tines of the supply rotor are bent in the direction of motion at their ends, the rotor rotates in the same direction.

It is disadvantageous that the pollutants have to be picked up from the ground in the direction of motion and must be guided past the supply rotor over a range of 180°. Impurities flung away forwardly by the tines partly bounce against a rotor housing and partly fall back onto the beach; due to this they come in front of the supply rotor again and must be picked up again.

The rotational speed of the rotor is added to the driving speed in the pickup area so that the refuse is tangentially flung forwardly in the direction of motion upon contact with the tines. In this fashion, pollutants can accumulate increasingly in front of the supply rotor and impair a further use.

The tines are greatly loaded when striking against the pollutants or the sand due to the high relative speed, and they may break.

Fibrous pollutants such as algae can wind themselves around the supply rotor and the tines due to the rotation of the supply rotor and the long entrainment up to the delivery to the transport belt and are matted together with it. In the case of greater algae pollution the known supply rotor must be cleaned frequently and freed from the algae.

Due to the design of the supply rotor and its allocation to the transport belt, pollutants are only picked up from the beach, which are seized by the rotor. Pollutants not picked up by the supply rotor cannot be picked up by the transport belt and remain on the beach.

The entire vehicle frame with all means attached thereto is lowered for the vertical adjustment of the supply rotor. The wheels mounted on a strap-shaped mounting are pivoted rearwardly by an actuating means, and due to this the entire vehicle is lowered. A vertical adjustment of the supply rotor relative to the transport belt is not possible. The distance between supply rotor and transport belt can likewise not be varied. Bulky pollutants cannot be picked up, and lead possibly to a damage to the vehicle.

A separation of pollutants and sand only takes place in the known beach vehicle by means of a sieve belt connected downstream of the transport belt. It must transport both the pollutants and the sand. This can in particular greatly load the vehicle in terms of weight, in particular if the sand is moist. Part of the sand with the pollutants is moreover further transported up to the collecting receptacle. The collecting receptacle is filled prematurely and must be exchanged for another receptacle or be emptied.

SUMMARY OF THE INVENTION

The invention is based on the object of providing a vehicle for beach cleaning of the type mentioned at the beginning which is improved as regards the supply, pickup and transport of refuse and the separation of the refuse and sand and the disposal of the pollutants.

This object is attained in a vehicle for beach cleaning having the features of the preamble of claim 1 by the fact that a swivel frame supporting the garbage pickup and the supply rotor is mounted in lowerable fashion on the vehicle frame for the vertical adjustment, the supply rotor is pivotably mounted on it by means of links across a swivelling range and is in particular rotatable counter-clockwise about an axis of rotation mounted on the links.

The supply rotor is disposed in a first, front operating position for the supply of garbage and/or sand to the garbage pickup in the direction of motion in front of the pickup V-ledge disposed in front of the garbage pickup, the distance between the V-ledge and the axis of rotation of the rotor is minimal in a second, central operating position, and the rotor is disposed at a distance to the V-ledge or the garbage pickup which is greater as compared with the second operating position in a third, rear operating position.

Consequently not the entire vehicle frame must be lowered according to the invention for the vertical adjustment of the garbage pickup, but only the swivel frame. Depending upon the application, the garbage pickup is lowered with the pickup V-ledge to the sand or into the sand. The pollutants and, possibly, sand are picked up via the V-ledge. The supply rotor is also lowered at the same time. Since it is mounted pivotably relative to the garbage pickup, both the distance of the supply rotor to the garbage pickup or the V-ledge and the height of the supply rotor relative to the sand can be varied indepedently of the garbage pickup.

The supply rotor is disposed in the direction of motion in front to the V-ledge, and thus also in front of the garbage pickup in a first operating position. If the V-ledge rests approximately on the sand in this position, the supply rotor rotates above the sand or penetrates only somewhat into the sand surface. The garbage pickup supplies all superficial pollutants to the garbage pickup in this position. Only a very small sand capture takes place, and a high driving speed is consequently possible. Since the rotor rotates moreover counter-clockwise, rotational speed and driving speed are not added, which leads to a lesser load of the rotor. The rotor flings the pollutants in the direction of the V-ledge and the garbage pickup, a partial separation of pollutants as a function of their weight taking place at the same time. More light-weight pollutants are flung over a greater distance in the direction of the garbage pickup than heavier ones, e.g. sand.

Impurities possibly not seized by the supply rotor are subsequently still picked up by the V-ledge and conveyed to the garbage pickup. In this fashion, all pollutants are picked up from the beach up to a certain penetration depth and the beach is thoroughly cleaned.

The first operating position is in particular of advantage in the case of wet sand or in the flood border area, since only little sand pickup takes place and the surface is thoroughly cleaned.

The second operating position of the supply rotor is preferably used for dry sand. In this position the rotor does not only serve for supplying pollutants to the garbage pickup, but also for accelerating the sand and the pollutants picked up by the V-ledge. The V-ledge is partly immersed in the sand. The supply rotor forming a duct with the V-ledge catches partly the sand and in particular the garbage lying on the surface of the sand. In similar fashion as in the first operating position, the rotor flings the materials located in its area of rotation in the direction of the garbage pickup. The lighter parts are flung over a greater distance than the heavier parts. In this fashion, sand and pollutants are already supplied to the garbage pickup in partly separated fashion and can more easily be separated still further on it. At the same time, a higher driving speed is possible due to the accelerated conveying of the picked up materials.

It is in particular possible in the third operating position to also pick up bulky parts. Since the distance between supply rotor and V-ledge or garbage pickup is relatively great, the parts picked up by the V-ledge can be guided to the garbage pickup through the gap formed between rotor and V-ledge. Due to its rotation, the rotor promotes the further transport.

The pollutants largely already separated from the sand by the supply rotor and the garbage pickup are freed from sand possibly entrained almost completely on the subsequent conveyor and supplied to the collecting receptacle.

The features of claims 2 and 3 are furthermore advantageous, since in this fashion the swivel frame is of a simple design and is disposed completely below the vehicle frame. The upper side of the vehicle frame can be additionally used for many purposes, such as for the transporting of building material, earth, gardening articles or the like. The swivel frame itself can be lowered with its end located in the direction of motion due to the mounting on its rear end. Supply rotor and pickup V-ledge are disposed on said end.

The features of claims 4 and 5 are advantageous since a multi-purpose use of the vehicle is possible in this fashion. The swivel frame together with garbage pickup and supply rotor can be exchanged for another swivel frame with corresponding means by means of detachable quick-action closures. A retrofitting of the vehicle to other fields of application is possible without great time expenditure. The flexibility of the vehicle is increased by this. A use for cleaning asphalted roads is e.g. also possible, the pickup V-ledge being preferably designed elastically and the supply rotor being particularly designed as brush roller in this case. The vehicle can also be used without swivel frame for general transport purposes.

The features of claims 6 to 9 are also advantageous, since the garbage pickup can be used for many fields of application in this fashion. The pollutants are taken over from the supply rotor or the V-ledge by the elevator and are conveyed to the conveyor connected downstream. If the elevator has a drive of its own, its speed can be adjusted independently of the rotational speed of the supply rotor or of the speed of the conveyor and can be easily adapted to applications with different garbage volumes.

The design of the vehicle according to claims 10 to 12 is also advantageous. The pickup area of V-ledge, supply rotor and garbage pickup can be designed in accordance with the vehicle width. The width of the flow of garbage is reduced in accordance with the given conditions via the disposed lateral blades and directing plates and can thus be passed through between the wheels attached to the wheel axis. The pollutants are picked up before they are possibly compacted with the wheels of the vehicle or even pressed into the ground, and the sand is cleaned across the entire width of the vehicle. A larger width of e.g. the V-ledge would basically also be possible, however, this would render the handling of the vehicle more difficult and persons might be injured due to the ends of the V-ledge laterally projecting from the contour of the vehicle.

The features of claims 13 and 14 are advantageous inasmuch as e.g. an automatically controlled lowering and lifting of the swivel frame is possible by means of the actuating means. The actuating means may be designed as a hydraulic actuating cylinder and can e.g. be remotely controlled by the driver of the vehicle. In order to be able to use the entire width of the swivel frame for the garbage pickup, the actuating means is disposed laterally on the frame.

It is furthermore advantageous if the angle of incidence for the garbage pickup of the pickup V-ledge relative to the ground is greater than the angle of incidence of the garbage pickup. In this fashion a narrowing transport duct is obtained between pickup V-ledge and supply rotor in the second operating position for the further transport of picked up garbage and sand, the end of the transport duct having a larger aperture angle so that the material picked up due to this can be distributed better across the garbage pickup.

A further development of the vehicle according to claims 16 to 18 is furthermore suitable. Material possibly flung upwardly or potentially beyond the garbage pickup by the rotor is recovered and deflected back into the garbage pickup by means of the baffle lining. At the same time, lumps are e.g. comminuted during the impact, which renders a subsequent separation of garbage and sand easier on the garbage pickup or the conveyor. The height of the baffle lining decreasing in particular oppositely to the direction of motion prevents that garbage or sand is flung away beyond the garbage pickup. The covering of the baffle lining serves additionally as a stop during the swivelling back of the swivel frame in the direction of the vehicle frame and for mounting the swivel axis of the rotor.

Advantageous developments of a supply rotor suspension are revealed by claims 19 to 21. Due to the use of the U-shaped frame, the supply rotor is suspended by means of the frame fundamentally in pendulous fashion. The entire frame can be pivoted about the swivel axis by means of the flange bearing projecting from the U-web and the corresponding bearing straps projecting from the covering.

The rotor is thus suspended easily accessibly. A pivoting across the swivelling range comprising the operating positions is moreover possible in a very simple fashion due to the arrangement of the flange bearings and bearing straps. The swivel radius of the supply rotor is relatively large, but nevertheless it is possible to pivot the swivel frame up to close to the vehicle frame, flange bearings and bearing strips of the rotor being disposed laterally next to the vehicle frame. A vertical fine adjustment of the rotor is moreover possible thanks to the special mounting of the axis of rotation of the rotor.

In order to adjust the supply rotor independently of other means in its rotational speed it is furthermore advantageous if a driving means is allocated to one end of the axis of rotation of the rotor. This may be a hydromotor which is connected to the hydraulic system of the vehicle and can possibly be adjusted by the driver.

The features of claims 23 and 24 are also advantageous, since the rotor can be pivoted independently of the garbage pickup due to the actuating means for pivoting the rotor. The actuating means can e.g. be designed as a hydraulically operable piston. The actuating means is attached with one end near the axis of rotation of the rotor so that no greater leverage occurs. In order to render the pivoting easier, the other end of the actuating means is disposed on a side wall of the baffle lining.

The supply rotor comprises a plurality of radially projecting tines defining the rotor circumference in an advantageous embodiment. The pollutants or the sand are flung in the direction of the V-ledge or the garbage pickup by means of the tines. The tines can be designed as elastic tines of metal or plastic material fixedly disposed on the axis of rotation of the rotor. It is likewise possible to mount the tines in spring-loaded fashion.

In order to achieve a minimum distance between V-ledge and axis of rotation of the rotor in the second operating condition and to optimize the transport effect of the rotor in this position it is advantageous if the pickup V-ledge extends substantially in a direction in parallel to a tangent of a swivel curve in the direction of motion, the swivel curve being defined as envelope of a part of the rotor circumference opposite to the swivel bearing.

Advantageous developments of supply rotor and V-ledge result from the features of claims 27 to 30.

The features of claims 31 and 32 are advantageous inasmuch as an additional separation of the garbage from the entrained ground materials is possible by means of the conveyor. In order to prevent a soiling of or damage to the wheel axis and all lines located below the conveyor means, the installation of a baffle plate above the rear axle is advantageous. A deflection axis can be formed as an unbalanced shaft on the conveyor but also on the garbage pick up and facilitate the shaking off of sand or ground material by a specific vibrating movement vertically to the direction of transport.

It is advantageous for mounting the actuating means of the swivel frame if the front transverse bar of the vehicle frame projects laterally beyond the transverse bars up to about the width of the vehicle and the actuating means are mounted on its ends. At the same time, tipping means for a loading area disposed on the vehicle frame can be mounted on these ends. The vehicle frame is substantially formed by a frame rectangle formed by two longitudinal bars and two transverse bars and a frame triangle disposed on its front edge in one example of embodiment. A coupling means for a traction vehicle is disposed on the tip of the triangle.

In order to obtain a loading area being as large as possible, it is advantageous if the loading area extends almost completely across garbage pickup and conveyor. The collecting receptacle is pivotable across the loading area by means of two supports disposed laterally on the vehicle frame or on the loading area and can be emptied uniformly on the loading area.

The features of claims 35 to 37 are moreover advantageous inasmuch as a uniform dumping of the collecting receptacle across the entire length of the loading area is possible by means of the tipping connecting bars. The first garbage is directly emptied above the rear end of the loading area on the same via a dumping edge of the collecting receptacle, and the collecting receptacle is gradually further pivoted during the pivoting towards the front end of the loading area by means of the arrangement of tipping links and supports. The support of the collecting receptacle can be rotated from a substantially horizontal position into an approximately vertical position by means of a tipping means. Both the tipping means for the collecting receptacle and the tipping means for the loading area can be designed as hydraulically operable pistons.

The further development of the vehicle according to claims 38 to 40 is furthermore suitable. A vertical adjustment of the rear end of the vehicle is possible due to the wheel axis designed as a lift axis. The vehicle frame is lifted by means of the lifting means in particular for emptying the loading area, and the collecting garbage can also be dumped into a higher container.

BRIEF DESCRIPTION OF THE DRAWINGS

The solutions suggested according to the invention and advantageous examples of embodiment thereof are explained and described in the following by means of the Figs. represented in the drawing.

DETAILED DESCRIPTION OF THE PREFERRED EMBODIMENT

Figure 1:
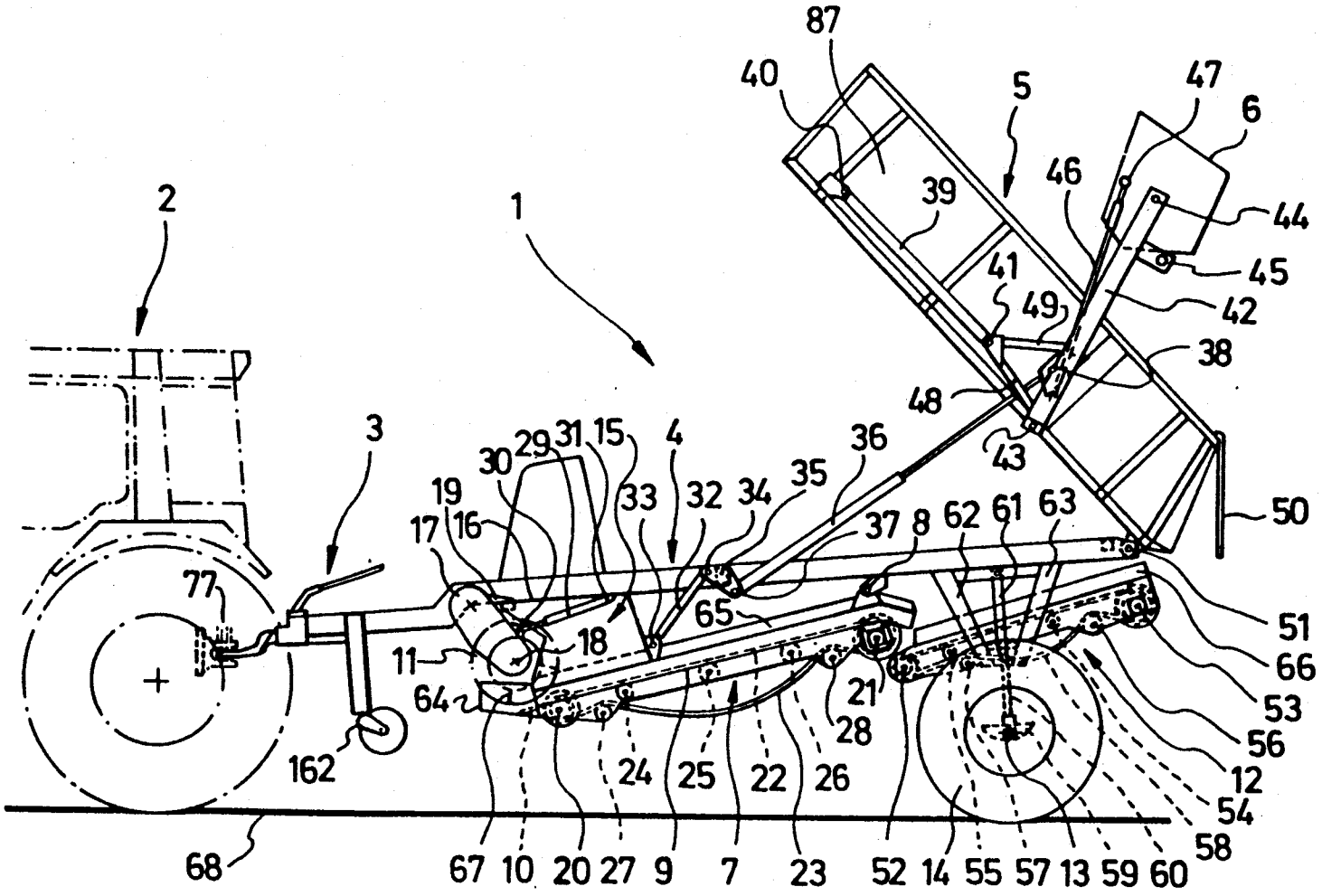
FIG. 1 shows a lateral view of the vehicle for beach cleaning with pivoted loading area and collecting receptacle.

The vehicle for beaching cleaning 1 according to the invention is represented in FIG. 1 together with a traction vehicle 2. The beach cleaning vehicle 1 is connected to the traction vehicle 2 by means of a coupling means 3 and a coupling means 77 formed on the traction vehicle 2 and movable across the ground 68. The vehicle 1 is substantially formed of the vehicle frame 4, an upwardly folded loading area 5, a swivel frame 7 disposed below the vehicle frame 4 and a collecting receptacle 6 pivoted across the loading area 5.

The coupling means 3 is disposed on the vehicle frame 4 on its front end, and a substantially horizontal tipping axis 51 for the loading area 5 is disposed on its rear end. The loading area 5 is upwardly tilted about the tipping axis 51 by about 45° with respect to the vehicle frame 4. An adjustable rear wall 50, which is pivotably mounted on the rear upper end of the loading area 5 is partly opened. A collecting receptacle pivoting means 39 is disposed on a side wall 87 of the loading area near the lower side pointing towards the vehicle frame. The same extends substantially in parallel and closely adjacent to the lower side of the side surface 87. The pivoting means 39 is mounted on a front end 40 on the side surface 87, while the rear end 41 is mounted on the tip of a triangular frame element 48, 49. The ends of the legs 48 and 49 of the triangular frame element are connected with the support 42. The support and the legs of the triangle close a substantially equilateral triangle. Near the connection between the legs of the triangle 48 and the support 42, the support 42 is pivotably mounted with its end 43 on the lower side of the lateral wall 87 of the loading area 5. The collecting receptacle 6 is pivotably mounted relative to the support 42 on the opposite end 44. The end 44 of the support 42 is disposed approximately in the surface centroid of a lateral surface of the collecting receptacle 6. A transverse bar 45 extends rectangularly to the support 42 along the collecting receptacle 6.

Figure 2:
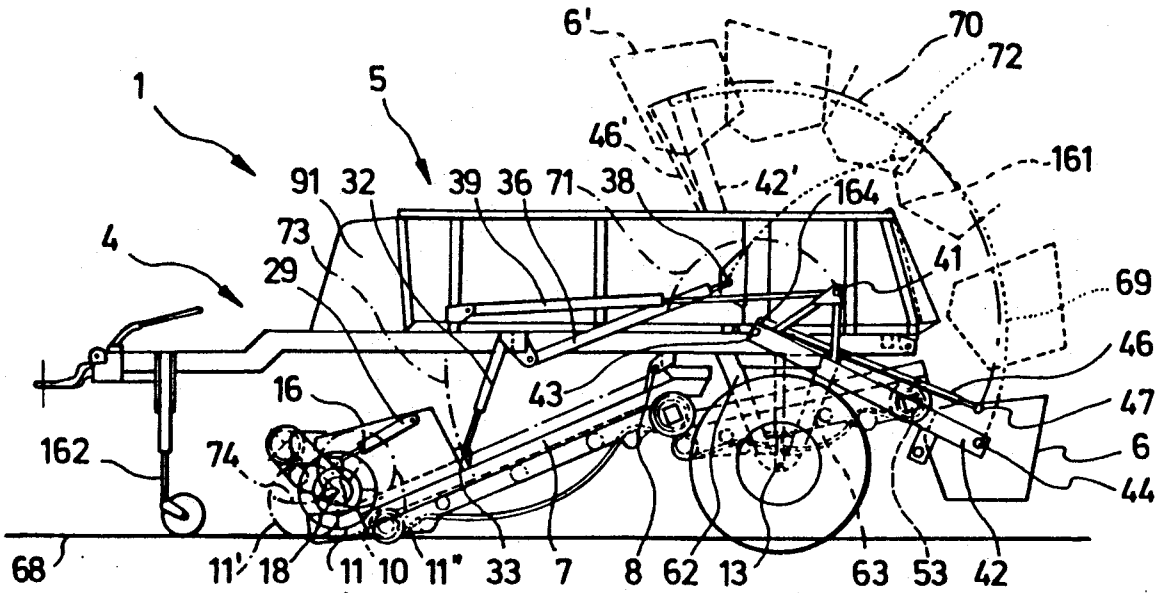
FIG. 2 shows a lateral view of the vehicle for beach cleaning with lowered swivel frame.
Figure 3:
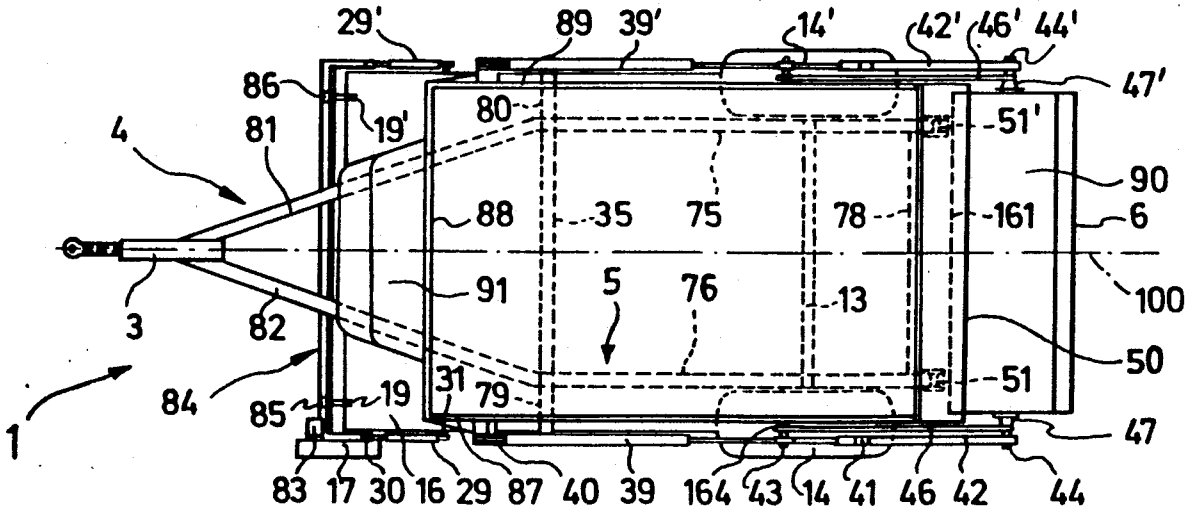
FIG. 3 shows a top view of the vehicle.

A tipping link 46 is rotatably mounted adjacent to the end 43 of the support 42 on the side wall 87 of the loading area 5. The bearing point 164 of the tipping link 46 is represented in FIG. 2 or 3 and is located staggeredly in the direction of the upper edge of the lateral wall 87 relative to the bearing point 43 of the support 42. The tipping link 46 is rotatably mounted on the upper end 47 on the collecting receptacle 6. The position of the link mounted 47 on the collecting receptacle is approximately at the intersection of the top surface of the collecting receptacle and a straight line running from the bottom surface of the receptacle to the top surface of the receptacle, which line passes through the mounting location 44 of the receptacle 6 and the support 42. The tipping link 46 is designed with a length being somewhat smaller than that of the support 42.

The loading area 5 is pivoted with respect to the vehicle frame 4 by means of a loading area tipping means 36 which is disposed between a transverse bar 35 of the frame 4 and the lateral surface 87 of the loading area 5. The tipping means 36 is rotatably mounted on the transverse bar 35 with one end 37 and is disposed approximately above the end 43 of the support 42 centrally to the side wall 87 with the other end 38.

An actuating means 32 is rotatable mounted with one end 34 on the transverse bar 35 opposite to the end 37 of the tipping means 36. The actuating means 32 is rotatably mounted with its other end 33 on a swivel frame 7 disposed below the vehicle frame 4. The swivel frame (7) consists essentially of longitudinal bars forming a rectangle and at least one transverse bar. The rear end of the swivel frame is rotatably mounted on the vehicle frame.

The swivel frame 7 can be lowered in the direction towards the ground 68 by means of a substantially horizontal swivel axis 8 disposed near the rear end of the swivel frame by means of the actuating means 32. A number of rollers 20, 21, 24, 25, 26, 27 are rotatably mounted in the swivel frame 7. The rollers 20 and 21 serve as deflecting axes for a conveyor belt formed of an upper run 22 and lower run 23. The rollers 24, 25 and 26 are designed as supporting rollers and define a transport plane of the upper run 22 together with the deflecting axes 20 and 21. The rollers 27 and 28 are in each case disposed between the deflecting axes 20 or 21 and the supporting rollers 24 or 26 adjacent to them. They are downwardly staggered with respect to these rollers and not in contact with the upper run 22. The rollers 27 and 28 serve as tensioning rollers and are disposed below the lower run 23 and guide it in the direction of the upper run 22. The lower run 23 sags in the direction of the ground 68 between the tensioning rollers 27 and 28.

A baffle lining 15, which is a cover for the swivel frame 7 is adjacently disposed downstream of the supply rotor 11. The baffle lining consists of two lateral walls 134 and a covering 16, that extends between and connects the walls 134 at their upper ends. The baffle lining 15 is disposed on the swivel frame 7 above the deflecting axis 20 and the supporting roller 24. The baffle lining 15 points from the swivel frame 7 in the direction of the vehicle frame 4. In the pivoted condition of the swivel arm 7 represented in FIG. 1 a covering 16 of the baffle lining 15 is in abutment with the lower side of the vehicle frame 4 across its entire length. The end 33 of the actuating means 32 is disposed at the rear end of the baffle lining 15 near the swivel frame 7. A directing plate 65 is disposed between the swivel axis 33 and the end 8 of the swivel frame 7 mounted on the vehicle frame 4, which extends in the longitudinal direction of the swivel frame projecting beyond the upper run 22.

An actuating means 29 extends between a rear upper edge of the baffle lining 15 and a supply rotor 11 disposed before it for pivoting the rotor. It is mounted with its rear end 31 on the baffle lining 15 and with its front end 30 on the supply rotor 11.

The supply rotor 11 is rotatable about an axis of rotation. It has a plurality of radially projecting tines 67, wherein the tines may be spring tines. For example, the supply rotor may take the form of a brush roller or other conventional supply rotor. A driving means covering 17 extends between axis of rotation 18 and the vehicle frame 4. It projects partly laterally beyond the vehicle frame 4. A bearing strap 19 is directed towards the upper end of the covering 17. The bearing strap is disposed on a front edge of the covering 16 of the baffle lining 15.

In extension of the swivel frame 7 a lateral blade 64 partly laterally covering the supply rotor 11 is directly disposed below the supply rotor 11. The height of the lateral blade 64 corresponds approximately to the height of the end of the swivel frame 7, which is adjacent to it. While the swivel frame 7 encloses an acute angle with the vehicle frame 4 and points in the direction of the ground 68, the side blade 64 points in the direction of the traction vehicle 2 and somewhat upwardly, extending approximately in parallel to the opposite end of the swivel frame 7 pointing towards a conveyor 12.

The conveyor 12 is disposed between wheel axis 13 and vehicle frame 4. It has an inclination corresponding approximately to the swivel frame. A run 58 formed of upper run and lower run runs over deflecting axes 52 and 53 and over supporting rollers 54 and 55 and tensioning rollers 56 and 57. The direction of transport of the conveyor 12 and of the garbage pickup 9 disposed in the swivel frame 7 is the same and directed towards the rear end of the vehicle 1. The conveyor 12 also has laterally limiting directing plates 66 in similar fashion as the swivel frame 7.

A vertically adjustable garbage pickup is disposed below the vehicle frame 4. The garbage pickup includes an elevator with a front deflection axis 20 at the front end of the swivel frame 7 and a rear deflection axis 21 at the rear end of the swivel frame. The swivel frame 7 with the supply rotor 11 and the garbage pickup can be designed as a quickly exchangeable cassette unit.

The vehicle frame 4 is represented in lifted fashion with respect to the wheel axis 13 in FIG. 1. Two supporting arms 62 and 63 connected with the vehicle frame point from the vehicle frame in the direction of the wheel axis 13. A lifting cylinder 61 is disposed centrally between them. A lifting piston 60 is extended out of the lifting cylinder 61 almost completely, a holding element 59 partly encompassing the wheel axis 13 being disposed on its end. The holding element has a cross-section similar to an isosceles triangle. The lifting piston 60 is centrally connected to the base of this triangle.

The wheel 14 is almost completely visible when the vehicle frame 4 is lifted by means of the lifting means 60, 61.

A vertically adjustable actuating wheel 162 for depositing the vehicle 1 is disposed near the coupling means 3 vertically to the vehicle frame 4.

The beach cleaning vehicle 1 with the swivel frame 7 lowered to the ground 68 is represented in FIG. 2. The same elements are provided with the same reference numerals in accordance with FIG. 1 and will only be partly mentioned.

In this Fig. the loading area 5 is placed on the vehicle frame. The tipping means 36 moves its end 38 along the circular arc 72 when being actuated, the loading area 5 adopting approximately the position represented in FIG. 1 at the end of the circular arc. The tip 41 of the triangular frame part can be guided along the semi-circular arc 71 by means of the collecting receptacle swivel means 39. Whereas the collecting receptacle is pivoted as far beyond the loading area 5 as possible and the tip of the triangle 41 points in the direction of the swivel means 39 in the position of the collecting receptacle 6 shown in FIG. 1, the collecting receptacle 6 is disposed near the ground 68 below the rear deflecting axis 53 of the conveyor 12 in the position represented in FIG. 2. Upon actuation of the collecting receptacle swivel means 39, the surface centre 44 of the collecting receptacle 6 moves along the circle 69 up to the position of the collecting receptacle 6'. The end point 47 of the tipping link 46 moves at the same time along the arc 70. Due to the relative arrangement and length of support 42 and tipping link 46 described in FIG. 1, the corresponding guide arcs 69 and 70 intersect each other, and the collecting receptacle 6 points with its open end more and more in the direction of the loading surface 5 and can be emptied via a dumping edge 161 in the direction of the loading area 5.

The swivel frame 7 is lowered about the bearing point 8 with one end to the ground 68. A pickup V-ledge 10 disposed on the swivel frame 7 below the supply rotor contacts the ground 68 with its free end and the lateral blade 64 extends with its lower side substantially in parallel to the ground.

Upon the lifting of the swivel frame 7 in the direction towards the vehicle frame 4 by means of the actuating means 32, its end 33 mounted on the swivel frame 7 can be guided along the arc 73. The axis of rotation 18 of the supply rotor 11 can furthermore be pivoted across the swivel range 74 by means of the actuating means 29. The supply rotor is in a second operating position in the arrangement of the supply rotor represented in FIG. 2, while the positions 11' and 11" correspond to a first or a third operating position. They will be explained in greater detail in FIGS. 8 to 10.

As opposed to the representation of the vehicle frame 4 lifted in FIG. 1, the wheel axis 13 is mounted directly on the ends of the supporting arms 62 and 63 and the vehicle frame extends substantially horizontally.

A top view of the beach cleaning vehicle 1 is shown in FIG. 3. The vehicle frame 4 has a triangular frame section and an adjoining rectangular frame section connected with the coupling means 3. The triangular frame section is formed by two supports 81 and 82 extending symmetrically to the longitudinal direction 100 from the coupling means 3 in the direction of a first transverse bar 35. The tip of the triangle is disposed in the coupling means 3, while the base of the triangle is formed by the transverse bar 35. Longitudinal bars 75 and 76 adjoin the supports 81 and 82 in parallel to the longitudinal axis 100. The rectangular frame section is formed by these supports the transverse bar 35 and a transverse bar 78 disposed near the end of the vehicle. The longitudinal bars 75 and 76 have a distance corresponding to the distance of the wheels 14 and 14'. The loading area 5 is pivotably mounted on its rear ends 51 and 51', these ends projecting rearwardly beyond the transverse bar 78. While the transverse bar 78 extends from one longitudinal bar to the other, the transverse bar 35 being in parallel to it has a greater length. It projects with its ends 79 and 80 on both sides beyond the longitudinal bars by respectively the same length. The actuating means 32 and 36 are pivotably mounted on the outer ends of the transverse bar ends 79 and 80.

The loading area 5 is disposed above the frame 4 and is resting on it. A front wall 88, two side walls 87 and 89 and a rear wall 50 of the loading area 5 can be recognized in the top view shown in FIG. 3. The side walls or the front and rear wall are in parallel to the longitudinal bars 75 and 76 or the transverse bars 35 and 78 and form the rectangular loading area 5. The rear wall 50 extends at an angle to the vertical rearwardly in the direction towards the collecting receptacle 6 in accordance with the representation in FIG. 2. Whereas the upper edge of the rear wall 50 is disposed in front of the collecting receptacle, the lower edge which is closer to the collecting receptacle is disposed above an opening 90 of the collecting receptacle 6. The dumping edge 161 is thus located below the loading area 5. Dumping edge and the side of the collecting receptacle opposite to it extend substantially in parallel to the rear wall 50. The extension of the collecting receptacle 6 vertically to the longitudinal direction 100, i.e. its width, is slightly shorter than the inner distance of the side walls 87 and 89 of the loading area. The collecting receptacle 6 is centrally connected with the support 42 or 42' or the tipping links 46 and 46' with its transverse sides via the bearings 44 and 44' or 47 and 47'. The supports 42 and 42' extend in parallel to the tipping links 46 and 46' outside the side walls 87 and 89. Both supports 42 and tipping link 46 are connected 20 on their ends 43 and 164 with the side wall 87 and correspondingly with the side wall 89 on the other side. Laterally outside and in parallel to the side walls 87 and 89, collecting receptacle swivel means 39 and 39' are disposed on the side walls 87 and 89. The swivel means 39 extends between a first bearing point 40 and a second bearing point 41. The bearing point 41 is disposed above the support 42 in accordance with FIGS. 1 and 3 as tip of a triangle. The distance of support 42 and collecting receptacle swivel means 39 to the side wall 87 is substantially the same. The same applies mutatis mutandis to the collecting receptacle swivel means 39' on the other side wall 89 of the loading area 5.

A hydraulic covering 91 is disposed in front of the front wall 88 on the triangular frame section formed by the supports 81 and 82. The hydraulic covering extends symmetrically to the longitudinal direction 100, its side surfaces extending substantially in parallel to the supports 81 and 82 and projecting beyond them.

The covering 16 is disposed symmetrically to the longitudinal direction 100 below the hydraulic covering 91 and below the frame 4. The covering 16 projects slightly on both sides relative to the side walls 87 and 89 of the loading area 5, the actuating means 29 and 29' being disposed on these sides. The distance of these actuating means corresponds substantially to the distance of the collecting receptacle swivel means 39 and 39' or the distance of the supports 42 and 42'.

Bearing straps 19 and 19' are disposed on the front end of the covering 16 symmetrically to the longitudinal direction 100. The bearing straps are in engagement with bearing means 85 and 86 of a frame 84. The frame 84 extends in parallel to the front side of the covering 16 and laterally projects beyond it by two arms directed in the direction of the actuating means 29 and 29'. The driving means covering 17 is disposed on one side of the frame 84, a motor 83 projecting from the covering 17 in the direction of the longitudinal axis of the frame 84.

Figure 4:
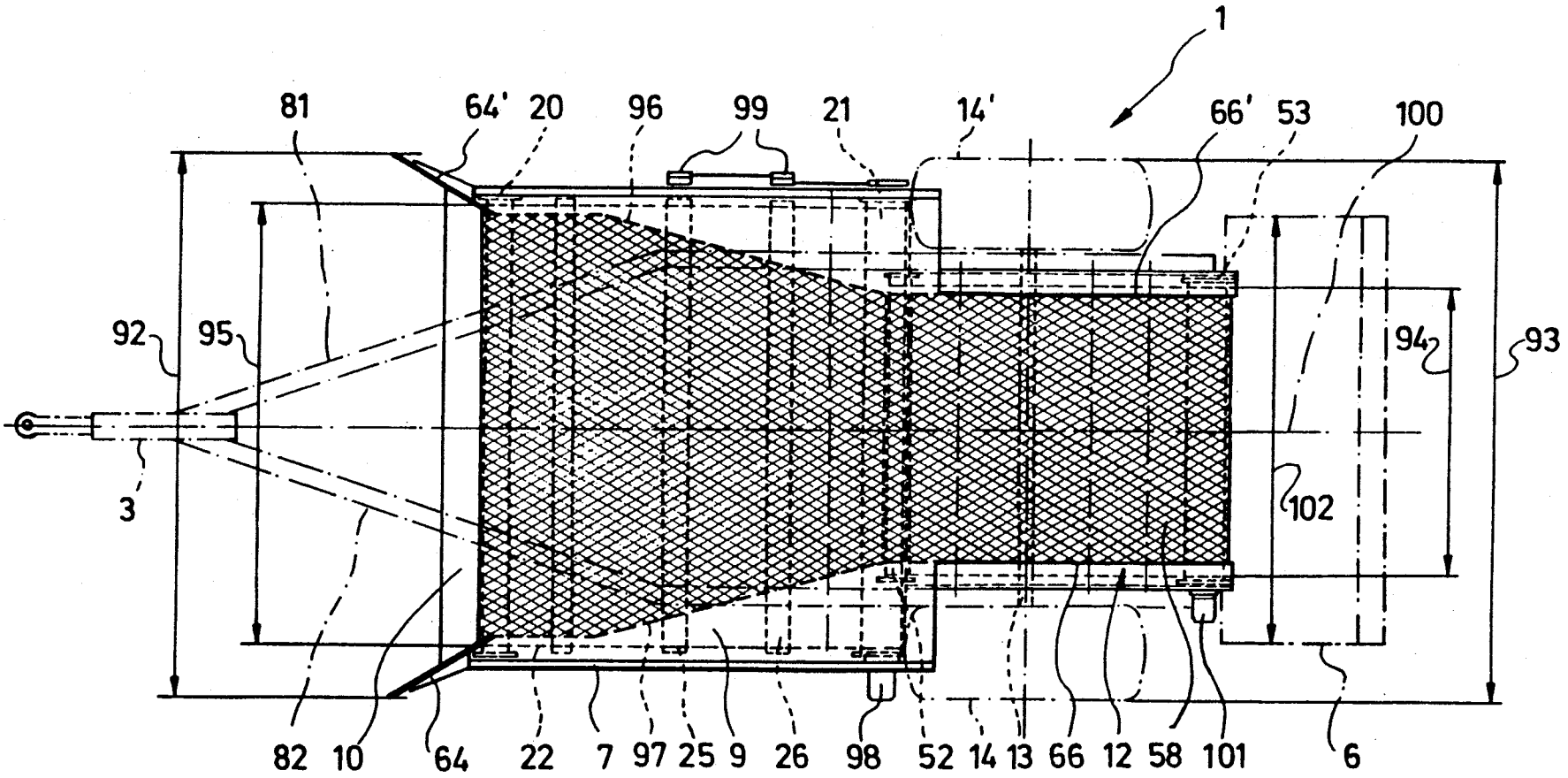
FIG. 4 shows a top view of garbage pickup and conveyor.

The beach cleaning vehicle 1 is represented in FIG. 4 in a top view of the garbage pickup 9, the conveyor 12 and the collecting receptacle 6.

Both the run 22 of the garbage pickup 9 and the run of the conveyor 12 are designed as sieve belts. They have a plurality of substantially rhombic openings.

Two lateral blades 64 and 64' outwardly bent symmetrically to the longitudinal direction 100 are disposed on the front side of the vehicle 1 on the ends of the V-ledge 10. The pickup width 92 of the lateral blades 64 and 64' corresponds substantially to the vehicle width 93. The V-ledge 10 projects from the garbage pickup 9 approximately beyond half of the longitudinal extension of the lateral blades 64 and 64' in the direction of the coupling means 3. The distance of the lateral blades is slightly smaller at the rear ends of the lateral blades than the width 95 of the upper run 22 of the garbage pickup 9. Directing plates 96 and 97 extending symmetrically to the longitudinal direction 100 adjoin these ends. They extend across a section directly adjoining the lateral blades 64 and 64' in parallel to the longitudinal direction 100, while they converge towards each other in the subsequent section. The distance of the directing plates 96 and 97 is somewhat smaller at the end of the garbage pickup 9 than the width 94 of the run 58 of the conveyor 12. The conveyor is disposed with its front deflection axis 52 below the rear deflection axis 21 of the garbage pickup in accordance e.g. with FIG. 1. The directing plates 96 and 97 are continued by parallel directing plates 66 and 66' of the conveyor up to its rear end. The collecting receptacle 6 is disposed on this end with a width 102, this width being greater than the width 94 of the upper run 58 of the conveyor 12.

A drive means 98 is disposed on one side of the rear deflection axis 21 for driving the garbage pickup 9. At least the supporting rollers 25 and 26 are drive-connected with the deflection axis 21 by means of driving connections 99.

The conveyor 12 also has a driven means 101 disposed on one side on its rear deflection axis 53.

Since the conveyor 12 is disposed between the wheels 14 and 14' above the wheel axis 13, its width 94 is smaller than the inner distance of the two wheels.

Figure 5:
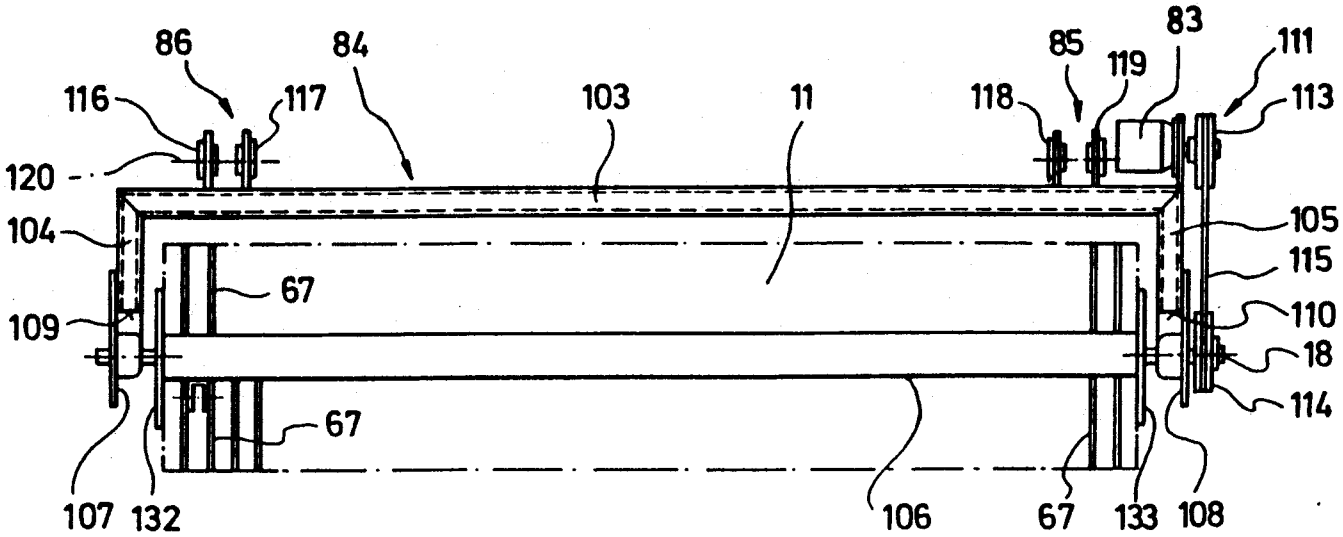
FIG. 5 shows a front view of the supply rotor.

The supply rotor 11 is represented in FIG. 5. The frame 84 is substantially of a U-shape. A U-web 103 extends horizontally and in parallel to the swivel axis 120 of the rotor or the axis of rotation 18 of the rotor. The U-web 103 has U-legs 104 and 105 disposed rectangularly to it on its ends. They extend up to near above a rotor shaft 106 concentric to the axis of rotation 18. Bearing flanges 107 or 108 are disposed on the ends 109 and 110 of the U-legs 104 and 105. The bearing flanges are placed from the outside on the U-legs 104 or 105 and connected with them.

The axis of rotation 18 is mounted in the bearing flanges 107 and 108.

Concentric rotor end disks 132 and 133 are disposed on the axis of rotation 18. The rotor end disks limit the supply rotor 11 in the direction of the axis of rotation. A plurality of radially projecting tines 67 are disposed on the rotor shaft 106. Only a few tines are represented in FIG. 5 in order to illustrate this.

Bearing means 85 and 86 are disposed on the U-web 103 to mount the supply rotor 11 on the swivel axis 120.

The bearing means are formed in each case by a pair of bearing flanges 116, 117 or 118, 119. The bearing flanges have a corresponding opening to receive the swivel axis.

A drive means 111 is disposed on one side of the supply rotor 11. The drive means 111 comprises a motor 112 disposed above the U-web 103 and a drive disk 113 mounted on its driving axis. The drive disk 113 is connected with a drive disk 114 coaxially disposed on the axis of rotation via a V-belt 115.

Figure 6:
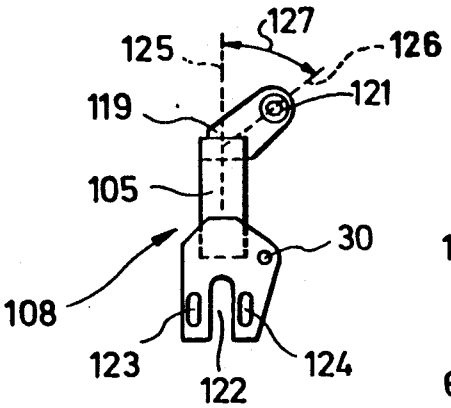
FIG. 6 shows a lateral view of a frame for mounting the supply rotor.

A lateral view in particular of the flange bearing 108 is represented in FIG. 6. It is substantially of a U-shape. Oblong holes 123 and 124 are disposed in the U-webs symmetrically to an oblong groove 122 receiving the axis of rotation. A U-leg has an enlargement, in which a bore 30 is disposed. One end of the actuating means 29 can be mounted in this bore.

A U-leg 105 of the frame 84 of FIG. 5 is visible above the bearing flange 108. Both the oblong groove 122 and the U-leg 105 extend vertically in the direction 125. The bearing flange 119 extends at the upper end of the U-leg 105 in the direction 126. The bearing flange has a swivel bearing bore 121. The angle 127 is enclosed between the direction 125 of the oblong groove 122 and the direction 126 of the bearing flange 119.

Figure 7:
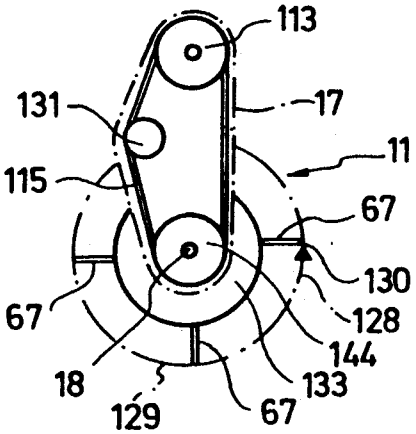
FIG. 7 shows a lateral view of a driving means of the supply rotor.

The driving means of the supply rotor 11 is represented in FIG. 7. The rotor end disk 133 is disposed concentrically to the axis of rotation 18. Tines 67 project radially beyond the rotor end disk and define the circumferential line upon rotation in the direction 128.

The drive disk 114 is connected with the axis of rotation 18 coaxially to the axis of rotation 18. The drive disk 113 connected with the motor is disposed vertically above this drive disk. Both are drive-connected via a V-belt. A tensioning roller 131 staggered laterally with respect to the connecting line of the two drive disks 113 and 114 is disposed between the drive disks 113 and 114 to tension the V-belt.

Figure 8:
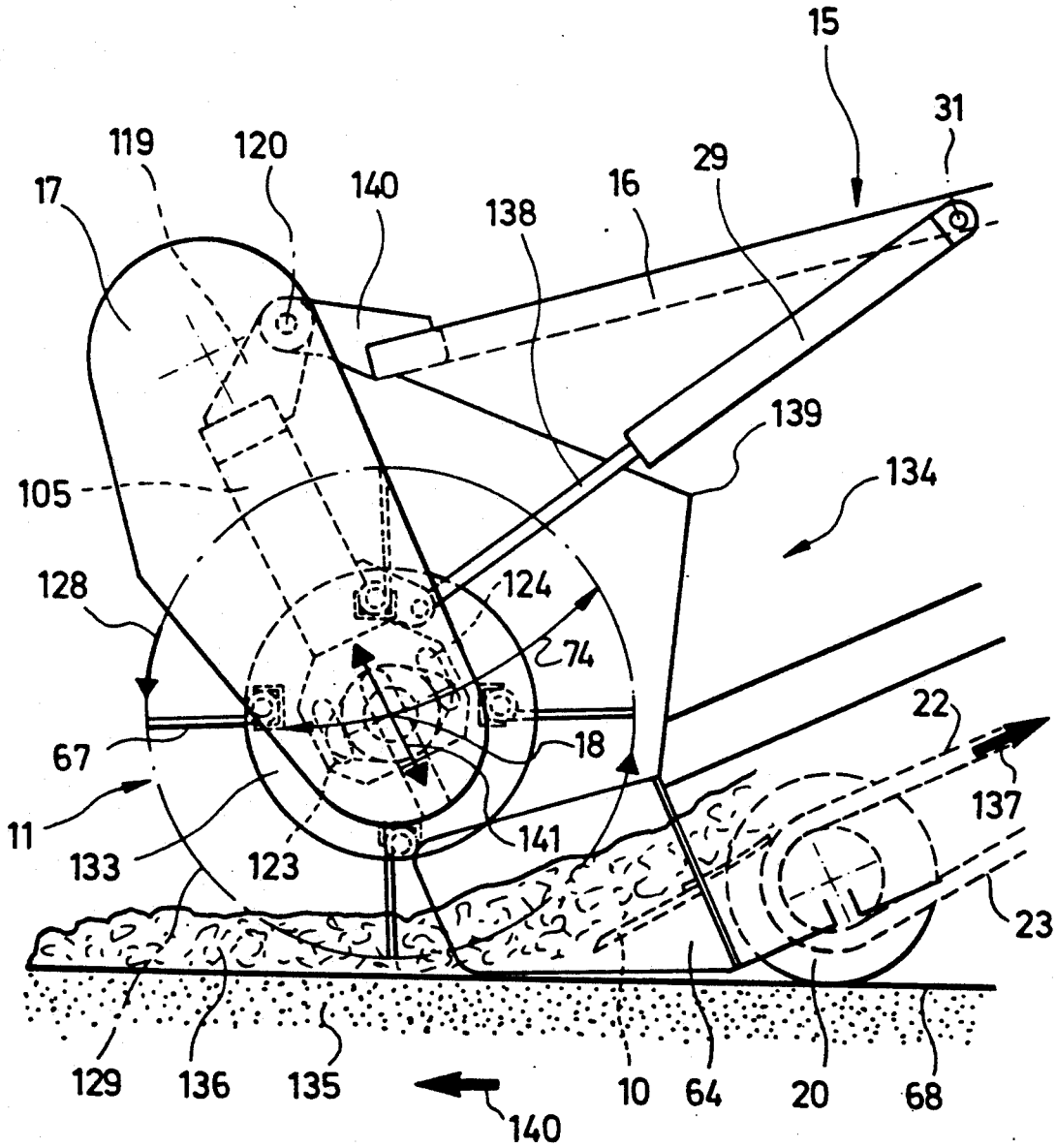
FIG. 8 shows a lateral view of a first operating position of the supply rotor.

The supply rotor is represented in a first operating position in FIG. 8. The same reference numerals designate the same elements as they are already known from the preceding Figs. They will only be dealt with partly.

The supply rotor 11 is pivoted forwardly about the swivel bearing axis 120 by means of the actuating means 29. The lowest point of the supply rotor 11 is located near the surface 68 and in front of the pickup V-ledge 10. The tines 67 engage in a layer of garbage 136 located on the surface upon counter-clockwise rotation 128. The garbage 136 is conveyed to the upper run 22 of the garbage pickup via the pickup V-ledge both by the rotation of the supply rotor 11 and by the movement of the vehicle in the direction 140. The garbage pickup transports the garbage away in the direction 137. In the operating position shown in FIG. 8 the pickup V-ledge 10 is disposed near the surface 68, but above this surface. The supply rotor can be pivoted forwardly that much by means of the actuating means 29 until the length of the piston 138 corresponds approximately to the length of the actuating means 29. In the position of the supply rotor being pivoted rearwardly to the greatest extent, the piston 138 is completely pulled into the actuating means 29. The entire swivel range of the supply rotor corresponds substantially to the swivel arc 74 of the axis of rotation 18.

A vertical fine adjustment of the axis of rotation 1B in directions 141 is possible by means of the oblong holes 123 represented in FIG. 6.

A wedge-shaped recess 139 is disposed in a lateral wall 134 of the baffle lining 15. It serves for receiving the axis of rotation 18 upon the pivoting of the supply rotor 11.

In the operating position represented in FIG. 8 the tines 67 do not engage into the sand 135 located below the surface 68.

Figure 9:
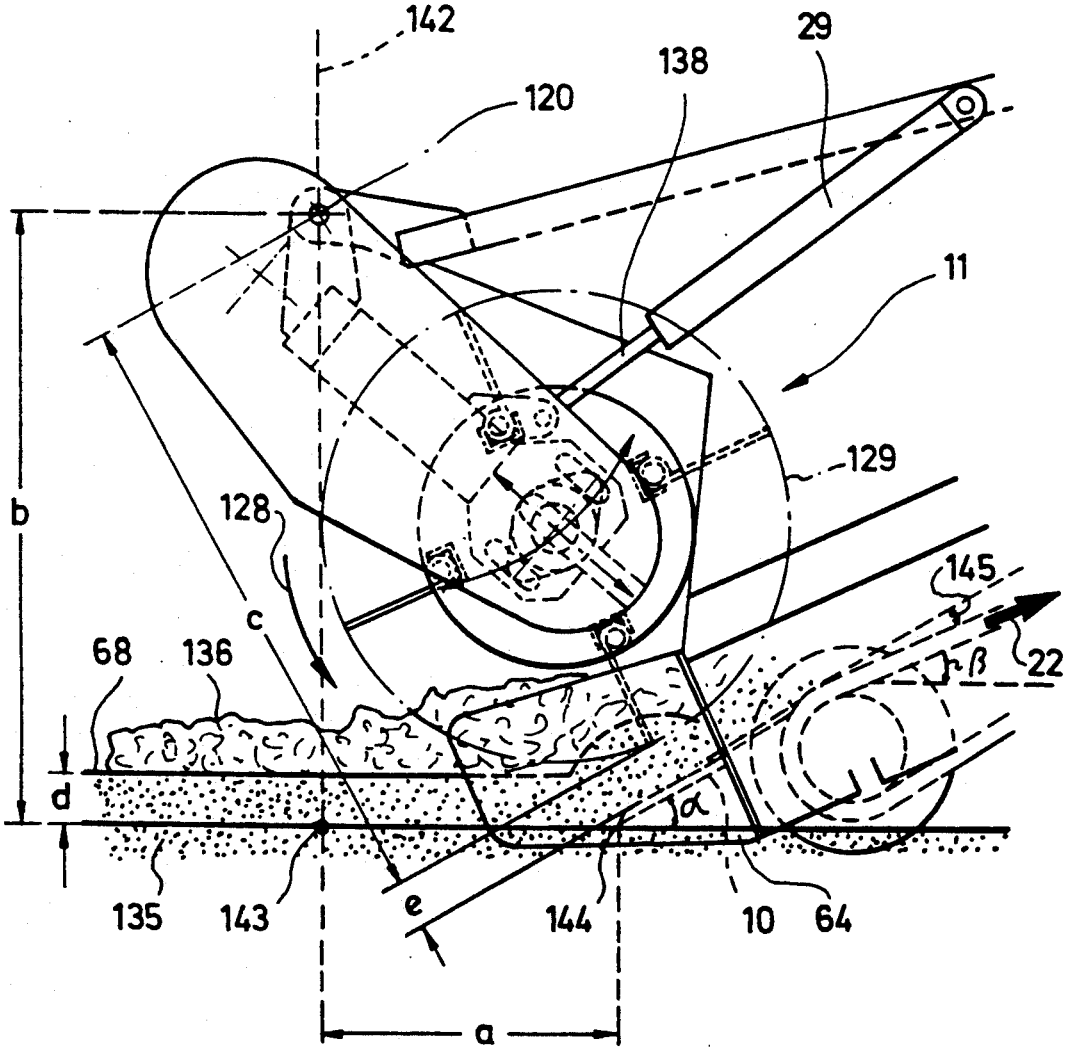
FIG. 9 shows a lateral view of a second operating position of the supply rotor.

Distance a, as seen in FIG. 9, is measured by forming a right angle between a substantially vertical line from the swivel bearing 120 to the ground surface and a substantially horizontal line from the tip 144 of the V-ledge 10, wherein a is equal to the distance between the tip of the V-ledge and the base point of the right angle. The distance a should be less than or equal to 1.5 r, wherein r is the radius of the rotor 131, and greater than or equal to 0.8 r, preferably a is approximately 1.15 r.

Distance b is the distance of the swivel bearing 120 from the horizontal line measured by a. The distance b is less than or equal to 3.0 r and greater than or equal to 2.0 r, preferably b is approximately 2.4 r.

Distance c, the distance between the swivel bearing and the plane determined by the V-ledge is less than or equal to 3.2 r and greater than or equal to 2.5 r, preferably c is approximately to 2.8 r.

Distance e is the distance between the periphery of the supply rotor and the plane determined by the V-ledge.

A second operating position of the supply rotor 11 is represented in FIG. 9. The pickup V-ledge is introduced with its tip 144 into the sand up to the depth d in this case. Both sand 135 and garbage 136 is located between the pickup V-ledge 10 and the supply rotor 11. The supply rotor 11 is pivoted rearwardly that much in this operating position that the distance e between the circumferential line 129 and the V-ledge 10 is minimal. Further characteristic magnitudes according to the invention are the distance a of the tip 144 of the pickup V-ledge 10 and the perpendicular base point 143 of the perpendicular 142 passing through the swivel axis 120 and the distance b or c of the swivel axis 120 from the perpendicular base point or the plane formed by the pickup V-ledge 10.

The pickup V-ledge encloses an angle $\alpha$ with the horizontal, which is greater by the angle 145 than the angle $\beta$ enclosed between upper run 22 and the horizontal. Distance e is about ¼ to about 1/6 of the radius of the rotor.

Figure 10:
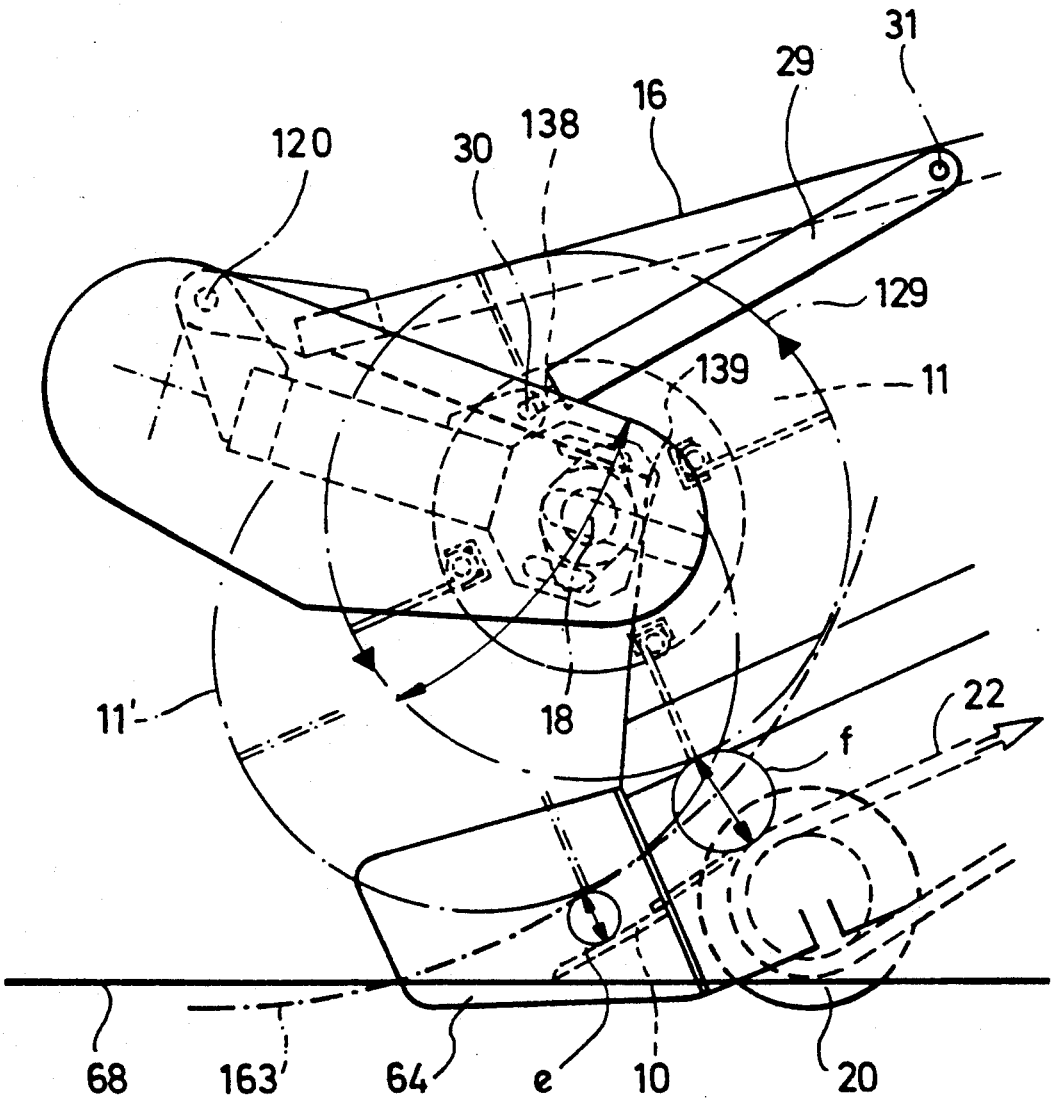
FIG. 10 shows a lateral view of a third operating position of the supply rotor.

The supply rotor 11 is represented in a third operating position in FIG. 10. The piston 138 is completely introduced into the actuating means 29 and the supply rotor is disposed in its position pivoted rearwardly to the greatest extent. The circumferential line 129 of the supply rotor almost contacts the covering 16 from below and the axis of rotation 18 is introduced as far as possible into the cutout 139 of the side wall of the baffle lining.

Circumferential line 129 and upper run 22 are disposed at the distance f in the third operating position. The distance f is approximately twice as great as the distance e between circumferential line and pickup V-ledge 10 in the second operating position. As can be recognized by means of the envelope 163 of the circumferential line 129 during pivoting, the distance e is the minimum distance.

Figure 11:
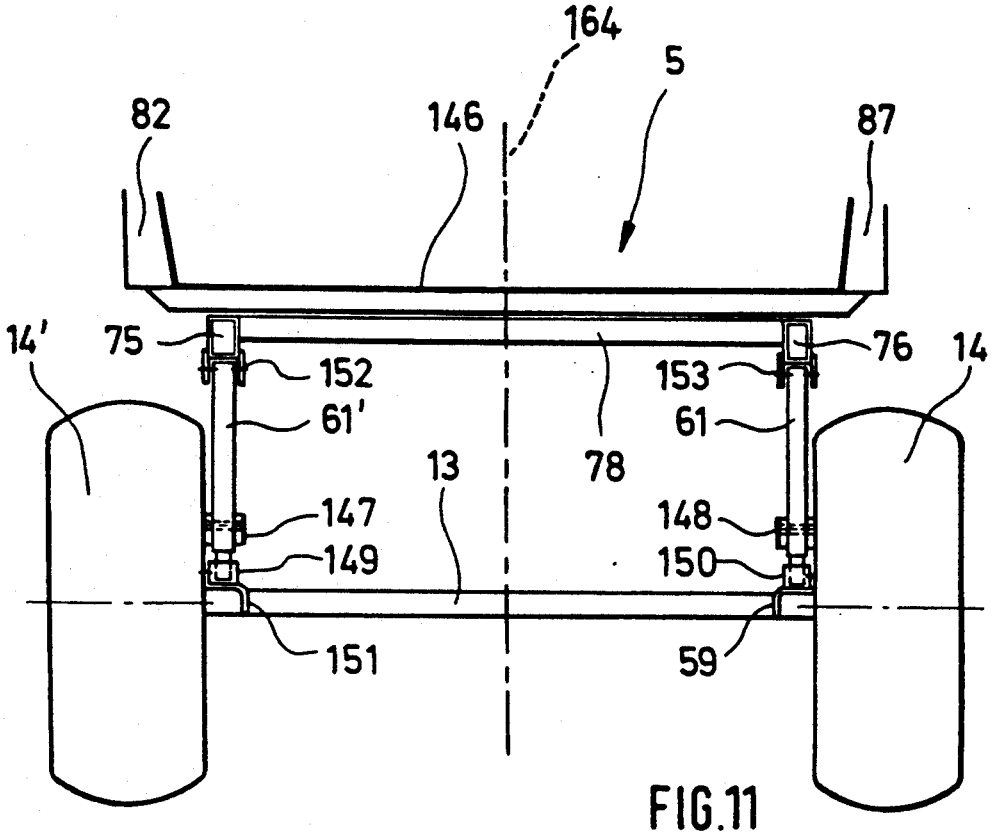
FIG. 11 shows a front view of a lift axis according to the invention.

A front view of the wheel axis 13 is represented in FIG. 11. A bottom wall 146 of the loading area 5 extends horizontally and rests on the transverse bar 78 of the vehicle frame. The vehicle frame is laterally enclosed by the longitudinal bars 75 and 76. The side walls 82 and 87 enclosing the loading area 5 in vertical direction are disposed above the longitudinal bars 75, 76 and outwardly staggered with respect to them.

Lifting cylinders 61 or 61' are attached to the longitudinal bars 75 and 76 by means of upper lifting means fastenings 152 and 153 resting against the longitudinal bars. The lifting cylinders are directly disposed below the longitudinal bars 75 and 76 and, like them, they are symmetrically disposed to the central vertical axis 164 of the vehicle. The lifting pistons 61 and 61' are fastened to the wheel axis 13 by means of holding elements 59 and 151 between the wheels 14 and 14' directly adjacent to them. Lower lifting means fastenings 149 and 150 are formed on each of the holding elements. The lifting pistons movable in the lifting cylinders are mounted on the same. The ends of the lifting pistons 61 and 61' are guided through lifting piston guides 147 and 148 above the lower lifting means fastenings 149 and 150.

Figure 12:
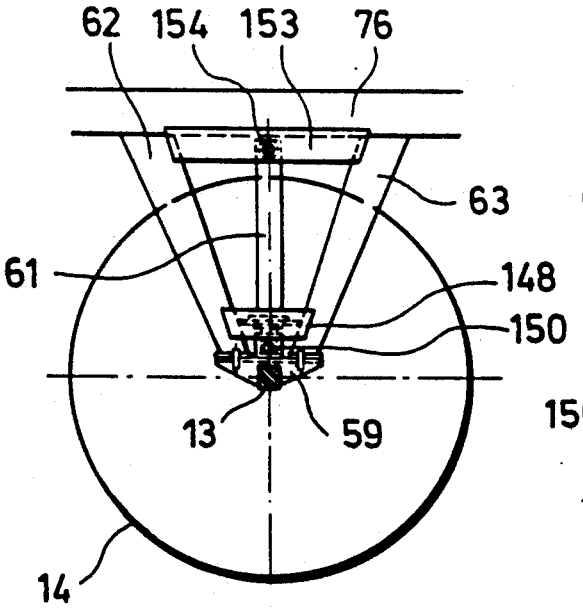
FIG. 12 shows a lateral view of the lift axis.

A lateral view of the lifting means is represented in FIG. 12. The upper lifting means fastening 153 is visible below the longitudinal bar 76. The upper lifting means fastening is substantially formed by a profile disposed laterally on the longitudinal bar 76 in parallel to the longitudinal bar 76. A bore 154 is centrically formed in this profile for mounting the upper end of the lifting cylinder 61. Two supporting arms 62 and 63 pointing in the direction of the wheel axis are disposed on the ends of the profile on the longitudinal bar 76. A profile 148 is mounted near the free ends of the supporting arms between the same for fixing the lower end of the lifting cylinder 61. The lifting cylinder 61 itself extends centrally to the supporting arms 62 and 63 enclosing substantially a triangle with the longitudinal bar 76. In the representation according to FIG. 12 the lower bearing point of the lifting means is disposed directly below the profile 148. The holding element 59 resting against the free ends of the supporting arms 62 and 63 is represented on the free ends of the supporting arms 62 and 63. Its cross-section has substantially the shape of an isosceles triangle. The free ends of the supporting arms 62 and 63 rest against the ends of the base line of this triangle. The lower bearing point 150 of the lifting means is disposed centrally between these free ends in the centre of the base line. The two legs of the triangle point in the direction of the wheel axis 13 and encompass it partly.

Figure 13:
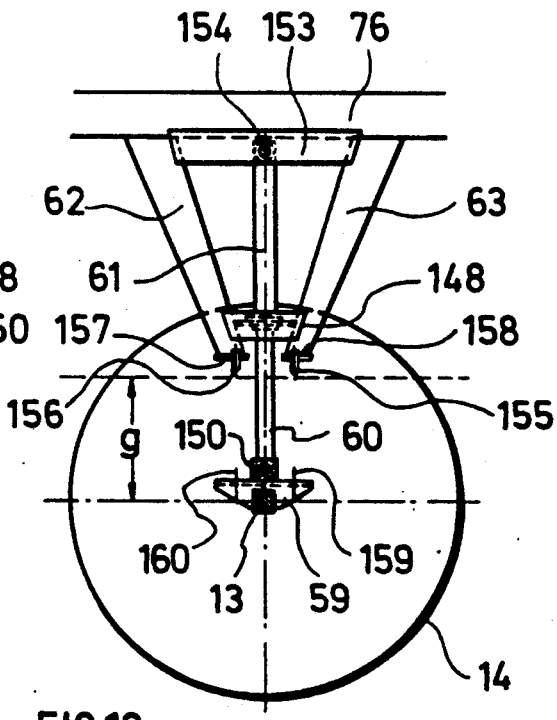
FIG. 13 shows a further lateral view of the lift axis.

The lifting means with maximally extended lifting piston 60 is represented in FIG. 13. The same reference numerals designate the same elements in accordance with FIG. 12. They will only be dealt with partly.

The longitudinal bar 76 is represented upwardly lifted by the distance g with respect to the wheel axis 13. The free ends 157 and 158 of the supporting arms have bearing journals 155 and 156. They are disposed in parallel to the lifting cylinder 61 or the lifting piston 60 and point towards the holding element 59. Corresponding bearing openings 159 and 160 are disposed in the holding element, which are in engagement with the bearing journals 155 and 156 in the representation according to FIG. 12.

What is now claimed is:

1. A vehicle for beach cleaning comprising a vehicle frame, at least one wheel axis disposed on said frame, a vertically adjustable garbage pickup, a conveyor adjoining the garbage pickup and conveying the garbage taken from the garbage pickup to a collecting receptacle, disposed at the rear end of the vehicle frame and a supply rotor allocated to a pickup area of the garbage pickup, characterized in that a swivel frame (7) supporting the garbage pickup (9) and the supply rotor (11) is mounted in lowerable fashion on the vehicle frame (4) for vertical adjustment, the supply rotor (11) is pivotably mounted on said swivel frame by means of links (84) across a swivel range (74)( and is rotatable about an axis of rotation (18) mounted on the links (84), the supply rotor (11) being movable from a first, forward operating position in which said rotor is rotatable to displace materials on the beach surface in a direction opposite to the direction of vehicle motion onto a pickup V-ledge (10), to a second, central operating position in which a distance e between the V-ledge (10) and the periphery of the rotor is minimum and a third, rear operating position in which the rotor (11) is disposed at a distance f to the V-ledge (10).

2. A vehicle according to claim 1, characterized in that the swivel frame (7), the garbage pickup (9) and the supply rotor (11) are disposed below the vehicle frame (4).

3. A vehicle according to claim 1, characterized in that the swivel frame (7) consists essentially of longitudinal bars forming a rectangle and at least one transverse bar, said swivel frame being rotatably mounted on the vehicle frame (4) by its read end.

4. A vehicle according to claim 1, characterized in that the swivel frame (7) with supply rotor (11) and garbage pickup (9) are designed as a quickly exchangeable cassette unit.

5. A vehicle according to claim 1, characterized in that the supply rotor (11) is designed with spring tines such, as a brush roller.

6. A vehicle according to claim 1, characterized in that the garbage pickup (9) comprises an elevator with a front deflection axis (20) at the front end and a rear deflection axis (21) at the rear end of the swivel frame (7).

7. A vehicle according to claim 6, characterized in that the elevator is designed as a chain belt, conveyor belt, sieve belt, raking belt or link conveyor.

8. A vehicle according to claim 6, characterized in that the elevator comprises an upper run and a lower run (22,23), the upper run running rearwardly.

9. A vehicle according to claim 6, characterized in that a drive (98) is allocated to at least one deflection axis, preferably, the rear deflection axis (21).

10. A vehicle according to claim 1, characterized in that the pickup V-ledge (10) is designed with a width corresponding approximately to the width (93) of the vehicle.

11. A vehicle according to claim 1, characterized in that the pickup V-ledge (10) comprises two substantially vertical, converging lateral blades (64, 64').

12. A vehicle according to claim 1, characterized in that the garbage pickup (9) comprises laterally limiting directing plates (65, 66) adjoining the lateral blades (64, 64'), which extend in parallel to each other across a part of said plates length and converge in funnel-shaped fashion in the direction of the rear end of the garbage pickup (9).

13. A vehicle according to claim 1, characterized in that at least one actuating means (32) is disposed between the vehicle frame (4) and the swivel frame (7) to pivot the swivel frame (7).

14. A vehicle according to claim 13, characterized in that the actuating means (32) is mounted laterally on the vehicle frame (4) and on the swivel frame (7).

15. A vehicle according to claims 1, characterized in that an angle of incidence $\alpha$ for the garbage pickup of the pickup V-ledge (10) relative to an ground (68) is greater than the angle of incidence $\beta$ of the garbage pickup (9).

16. A vehicle according to claim 1, characterized in that an open baffle lining (15) is substantially disposed on the front end of the swivel frame (7), which comprises two vertical side walls (134) connected to the longitudinal bars of the swivel frame (7) and a covering (16) connecting said lining.

17. A vehicle according to claim 16, characterized in that the side walls (134) are designed with increasing height in the direction of motion (140) and the covering (16) is in abutment with the vehicle frame when the swivel frame (7) is pivoted in the direction of the vehicle frame (4).

18. A vehicle according to claims 1, characterized in that a substantially horizontal swivel axis (120) of the rotor for mounting the link (84) of the supply rotor (11) is disposed on the front end of the covering (16).

19. A vehicle according to claim 18, characterized in that the links (84) are part of a U-shaped frame, whose U-shaped web (103) extends in parallel to the swivel axis (120) of the rotor and is mounted on the same by means of at least two bearings (85, 86) and whose two U-shaped legs (104, 105) laterally encompass the supply rotor (11) as links and receive the axis of rotation (18) of the rotor at said U-shaped legs two ends (109, 110).

20. A vehicle according to claim 19, characterized in that the bearings (85, 86) are designed in each case as a pair of spaced flange bearings (116, 117; 118, 119) projecting obliquely towards the rear and upward from the U-shaped web (103) and are in engagement with bearing brackets (19) projecting obliquely towards the front and upward from the front end of the covering (16).

21. A vehicle according to claim 19, characterized in that the ends (109, 100) of the U-shaped legs (104, 105), on which the axis of rotation (18) of the rotor is supported, have bearing flanges (107, 108), which have an oblong groove (122) opening on one side and parallel oblong holes (123, 124) laterally spaced to said oblong hole for the vertical fine adjustment of the axis of rotation (18) of the rotor.

22. A vehicle according to claim 1, characterized in that a driving means (111) is allocated to one end of the axis of rotation (18) of the rotor.

23. A vehicle according to claim 1, characterized in that at least one actuating means (29) for pivoting the rotor (11) is disposed between the rotor and the swivel frame (7).

24. A vehicle according to claim 23, characterized in that the rotor pivoting actuating means (29) is disposed between approximately one upper rear end of a side wall (134) of the baffle lining (15) and a bearing flange (107, 108).

25. A vehicle according to claim 1, characterized in that the supply rotor (11) comprises a plurality of radially projecting tines (67) determining the circumference (129) of the rotor.

26. A vehicle according to claim 25, characterized in that the pickup V-ledge (10) extends in the direction of motion (140) in a direction substantially in parallel to a tangent of a swivel curve (163), the swivel curve (163) being defined as an envelope of a part of the circumference (129) of the rotor opposite to the swivel bearing (120).

27. A vehicle according to claim 26, characterized in that the distance between the swivel curve (163) and the plane predetermined by the V-ledge (10) is about ¼ to 1/6 of the radius of the rotor in the second operating position.

28. A vehicle according to claim 1, characterized in that the distance a of a perpendicular base point (143), of a right angle formed at the intersection of a substantially vertical line through the swivel bearing (120) and a substantially horizontal line through the tip (144) of the V-ledge, (10) to the tip of the V-ledge is 0.8 $r \leqq a \leqq 1.5$ r, r being the radius of the rotor (11).

29. A vehicle according to claim 1, characterized in that the distance b of the swivel bearing (120) to a perpendicular base point of a right angle formed at the intersection of a substantially vertical line through the swivel bearing and a substantially horizontal line through the tip (144) of the V-ledge (10) is $2\ r \leqq b \leqq 3\ r$, being the radius of the rotor (11).

30. A vehicle according to claim 1, characterized in that the distance c between the swivel bearing (120) and the plane determined by the V-ledge (10) is 2.5 $r \leqq c \leqq 3.2$ r, r being the radius of the rotor (11).

31. A vehicle according to claim 1, characterized in that the conveyor (12) is disposed below the vehicle frame (4) with its front end disposed below the rear end of the garbage pickup (9) and its rear end disposed above an opening (90) of the collecting receptacle.

32. A vehicle according to claim 31, characterized in that the conveyor (12) extends above the wheel axis (13) and between the wheels (14, 14') disposed on the wheel axis (13) and has a width (34) which corresponds substantially to the distance of directing plates (65) on the rear end of the garbage pickup (9).

33. A vehicle according to claim 3, characterized in that a front transverse bar (35) of the vehicle frame (4) projects laterally beyond longitudinal bars (75, 76) of the vehicle frame up to about the vehicle width (93) and actuating means (32) for swivelling the swivel frame (7) and tipping means (96) for a loading area (5) are mounted on the transverse bars ends (79, 80).

34. A vehicle according to claim 33, characterized in that the loading area (5) extends almost completely across the garbage pickup (9) and the conveyor and is disposed on the vehicle frame (4) and the collecting receptacle (6) is held by two supports (42, 42') disposed laterally on the loading area (5), the supports being pivotably mounted on both ends (43, 43'; 44, 44').

35. A vehicle according to claim 34, characterized in that tipping links (46, 46') are disposed adjacent to the supports (42, 42'), which are mounted with the tipping links front end (164) on the loading area (5) directly above the supports (42, 42') and with their rear end (27, 27') substantially on the upper edge of the collecting receptacle (6) and have a length being smaller with respect to the supports (42, 42').

36. A vehicle according to claim 1, characterized in that the collecting receptacle (6) is designed as a dump body, the receptacle side facing the conveyor (12) being designed with a lower height than the opposite side to form a dumping edge (161).

37. A vehicle according to claim 34, characterized in that the supports (42, 42') each have a triangular connecting frame (48, 49) extending vertically to the support at the supports ends (43, 44) and rotatably mounted on the loading area (5), on whose triangular tip (41) the tipping means (39) is rotatably mounted.

38. A vehicle according to claim 1, characterized in that the wheel axis (13) is designed as a lift axis and is laterally mounted on the vehicle frame (4) by at least two converging supporting arms (62, 63) and a holding element (59) disposed on the free ends (157,158) of the supporting arms (62, 63) and encompassing the wheel axis (13) at least partly.

39. A vehicle according to claim 38, characterized in that the holding element (59) is connected with a variable-length lifting means (60, 61) mounted on the frame (4) and extending centrally between the supporting arms (62, 63) for the lifting and lowering of the vehicle frame (4).

40. A vehicle according to claim 38 or 39, characterized in that the holding element (59) comprises fixing openings (159, 160), which are in engagement with fixing journals (155, 156), which are formed on the free ends (157, 158) of the supporting arms (62, 63), at least in the case of abutment of the holding element (59) at the supporting arms (62, 63).

41. A vehicle according to claim 1, characterized in that the supply rotor (11) is designed with a width corresponding approximately to the width (93) of the vehicle.

42. A vehicle according to claim 1, characterized in that the garbage pickup (9) is designed with a width corresponding approximately to the width (93) of the vehicle.

43. A vehicle according to claim 28, characterized in that the distance a of the perpendicular base point (143) of the swivel bearing (120) to the tip (144) of the V-ledge (10) is preferably 1.15 r.

44. A vehicle according to claim 29, characterized in that the distance b of the swivel bearing (120) from the horizontal determined by the tip (144) of the V-ledge (10) is preferably 2.4 r.

45. A vehicle according to claim 30 characterized in that the distance c between the swivel bearing (120) and the plane determined by the V-ledge (10) is preferably equal to b 2.8 r.

* * * * *